United States Patent [19]

Peel

[11] 4,215,612

[45] Aug. 5, 1980

[54] SUPPORT APPARATUS FOR CHAIN SAW

[76] Inventor: James R. Peel, Rte. 2, Box 1113, Franklin, N.C. 28734

[21] Appl. No.: 911,226

[22] Filed: May 31, 1978

[51] Int. Cl.[2] ..... B27B 17/02

[52] U.S. Cl. ..... 83/796; 83/574; 83/589; 83/605; 83/490

[58] Field of Search ..... 83/796, 574, 490, 589, 83/605

[56] References Cited

U.S. PATENT DOCUMENTS

| | | | |
|---|---|---|---|
| 236,613 | 1/1881 | Nelson | 83/589 X |
| 1,484,598 | 2/1924 | Weniger | 83/605 X |
| 1,623,495 | 4/1927 | Reynolds et al. | 83/589 |
| 2,202,582 | 7/1940 | Hollister | 83/490 X |
| 2,851,067 | 9/1958 | Greenslate | 83/796 |
| 3,433,277 | 3/1969 | Ribley | 83/796 |
| 4,123,957 | 11/1978 | Niemela et al. | 83/796 |

*Primary Examiner*—Donald R. Schran

*Attorney, Agent, or Firm*—Lane, Aitken, Ziems, Kice & Kananen

[57] ABSTRACT

A chain saw is movably mounted on a frame for enabling the chain saw blade to move in a substantially straight-line path relative to the frame. The frame includes a bed for supporting a length of wood within the straight-line path of the saw blade. The saw blade is biased toward one side of the length of wood and a foot treadle is connected to the saw for overcoming the bias and moving the saw blade along the straight-line path to the other side of the length of wood.

15 Claims, 5 Drawing Figures

FIG. 3.
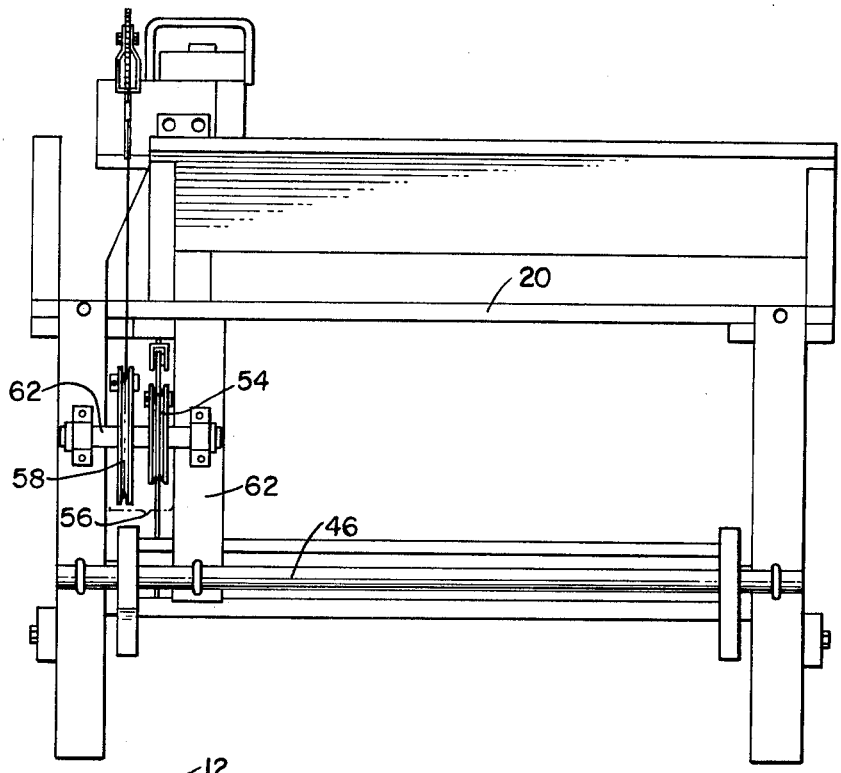
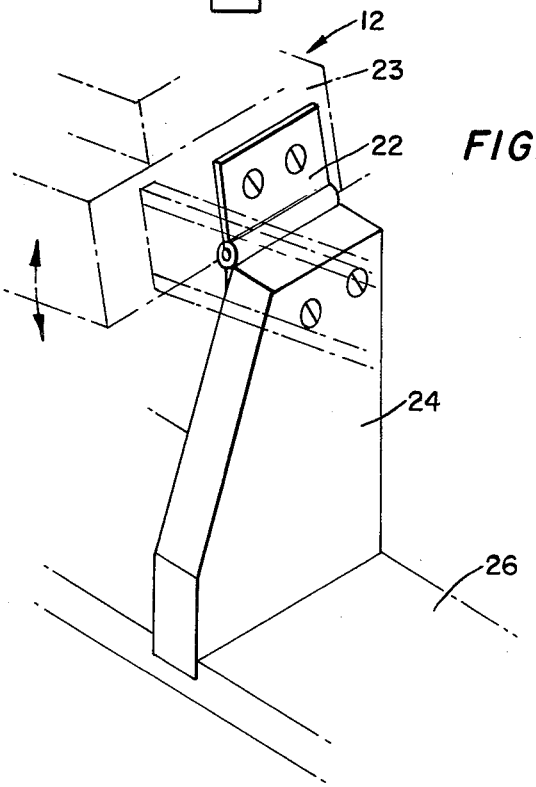
FIG. 4.
FIG. 5.
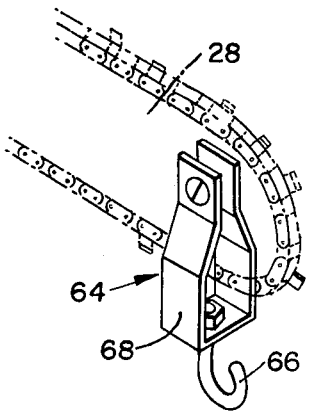

SUPPORT APPARATUS FOR CHAIN SAW

BACKGROUND OF THE INVENTION

This invention is directed to an apparatus for supporting a chain saw and, more particularly, to such an apparatus where the chain saw can be used to cut wood with significantly less physical exertion and much greater safety.

Anyone who has used a chain saw is aware that a great amount of physical exertion is required when cutting wood, which causes an undue amount of strain on the back muscles. This is because the operator must continually bend over and straighten up while raising and lowering the full weight of the saw. In addition, since most chain saws have a blade which extends about two-thirds the total length of the saw and most of the weight is in the rear of the saw where the engine and gas tank are located, it is difficult to obtain proper leverage when cutting. Therefore, this lack of leverage must be compensated by the operator pressing down harder on the blade by means of a handle which extends over the body portion of the saw which requires even greater exertion on the back muscles.

It is also common knowledge that a chain saw is extremely dangerous to operate. This is especially true when the wood which is being cut is not heavy enough to support itself and must be supported by the foot of the operator. This is an extremely dangerous practice because oftentimes the saw blade will buck erratically and cut the foot or leg of the operator.

SUMMARY OF THE INVENTION

The problems discussed above have been solved by the inventive support apparatus which requires significantly less exertion on the back of the operator and provides desirable safety features.

The chain saw support apparatus is formed of a support frame on which the chain saw is movably mounted so that the chain saw blade will move in a substantially vertical straight-line path relative to the frame. The frame includes a bed in the form of a V-shaped trough for supporting a length of wood substantially perpendicular to and within the straight-line path of the saw blade.

A spring is connected between the handle of the saw blade and the frame for biasing the saw blade in an upper poised or "ready" position. A foot treadle in the form of a bar extends across the lower front portion of the support frame and is connected by means of a cable to the front edge of the saw blade so that all of the force required to lower the saw blade through the wood and overcome the force of the spring is exerted by a leg of the operator who is standing upright. This frees one hand of the operator for steadying the log, while the other hand can be used to manipulate the chain saw throttle and control movement of the blade.

The portion of the cable which is connected to the foot treadle is connected to and wound around the smaller diameter pulley of a dual-diameter pulley arrangement which is rotatably mounted on the support frame. The portion of the cable connected to the saw blade is connected to and wound around the larger diameter pulley of the dual-diameter pulley arrangement so that when the operator presses down on the foot treadle greater leverage and less direct force is required in order to overcome the spring and pull the blade through the wood. When the force exerted on the treadle is released the spring will automatically return the blade to its "ready" position.

With this arrangement, significantly less physical effort is required to be exerted by the operator while at the same time providing for much safer operation of the saw.

BRIEF DESCRIPTION OF THE DRAWINGS

For a better understanding of the invention, reference may be had to the following description of a preferred embodiment of the invention taken in conjunction with the accompanying drawings, in which:

FIG. 3 is a front elevational view of the apparatus;

FIG. 4 is a perspective view showing in particular the hinge which is used to pivotally mount the chain saw on the support apparatus; and FIG. 5 is a partial perspective view of a chain saw blade showing a preferred coupling mechanism for connecting the end of the blade to a central cable.

DETAILED DESCRIPTION OF A PREFERRED EMBODIMENT

Figure 1:
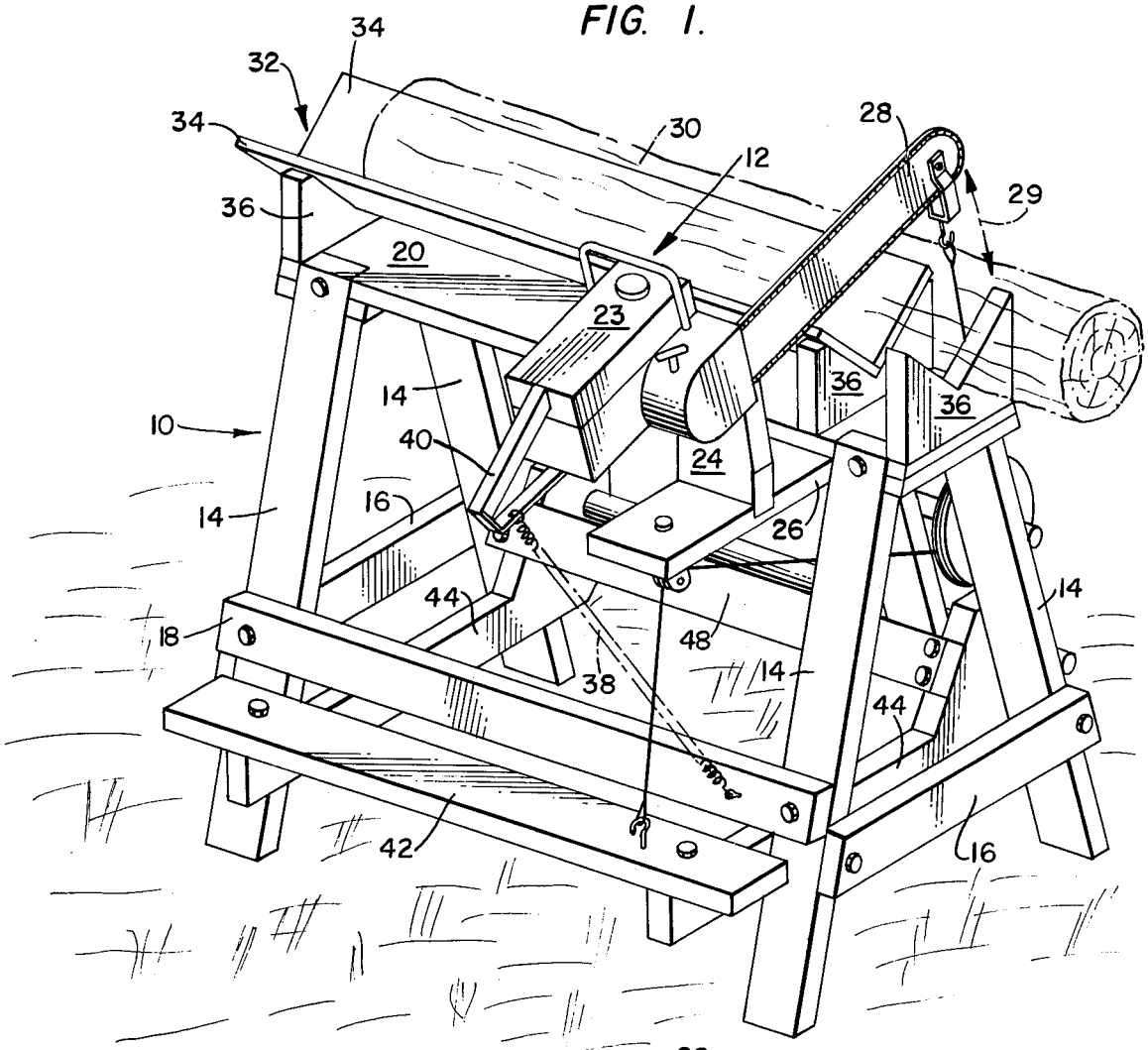
FIG. 1 is a perspective view of the chain saw support apparatus.

As shown in FIG. 1, a chain saw support apparatus is designated generally by reference numeral 10 and a chain saw by reference numeral 12. The support apparatus 10 includes a wooden support frame or sawbuck formed of four legs 14, side support braces 16, front support brace 18 and top support plate 20, all connected by suitable bolts.

The chain saw 12 is movably attached to the support apparatus by means of a hinge 22 (shown best in FIG. 4) which is connected between a front edge of the chain saw main body 23 and an upright support member 24 which is connected to the support frame 10 through a horizontal support member 26. As shown best in FIG. 4, the hinge 22 is connected to the chain saw body 23 and upright support member 24 by means of suitable bolts and is mounted so that the chain saw blade 28 is pivotally movable in a substantially vertical straight-line path depicted by an arrow designated by reference numeral 29 in FIG. 1.

A bed for supporting a log 30 is provided in the shape of V-shaped trough 32 formed of two boards 34 extending between a pair of upright support members 36 which contain V-shaped notches and are connected to the top support plate 20. A third notched upright support 36 is also connected to the top support plate 20 and located on the other side of the chain saw blade 28 with a space therebetween for supporting the outer end of the log 30 while it is being cut.

Figure 2:
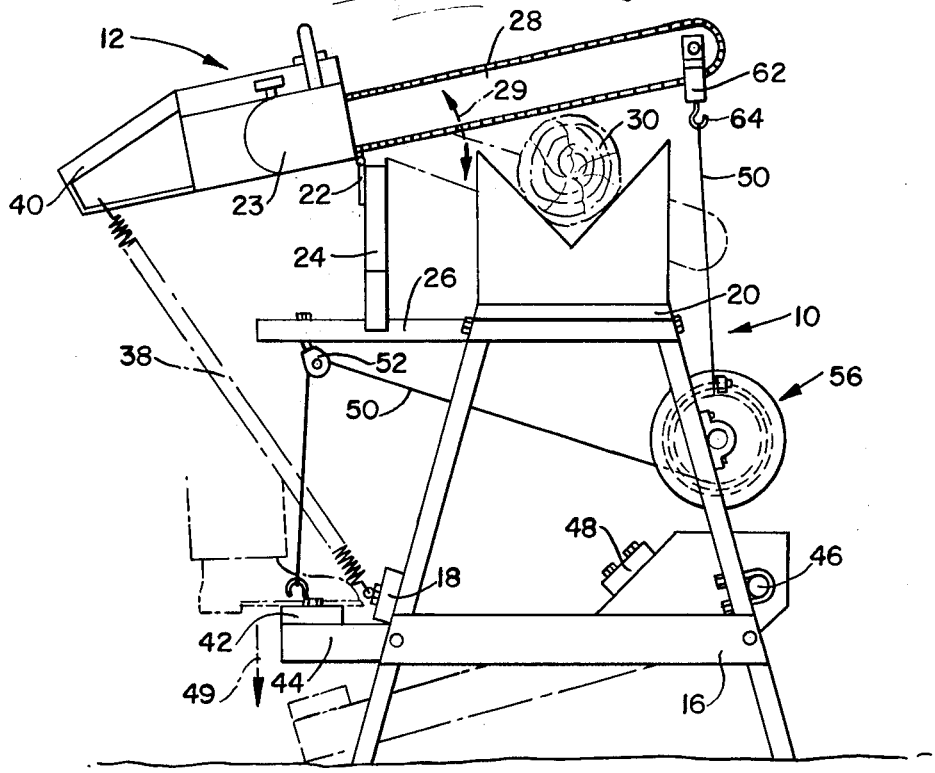
FIG. 2 is a side elevational view of the apparatus with the phantom lines showing the foot-operated treadle and chain saw blade in their lowered positions.

The chain saw 12 is maintained in an upper poised or "ready" position as shown best in FIGS. 1 and 2 by means of a spring 38 which is connected between the chain saw handle 40 and the support frame 10.

In order to move the chain saw blade 28 downward to cut the log 30, a foot-operated threadle is provided so that all of the force required to cut the log 30 is exerted through one of the operator's legs. The treadle is formed of a foot bar 42 which extends along the lower front of the support frame 10 and is connected through a pair of pivotally movable arms 44 to a bar 46 which is mounted on the rearmost legs 14 of the support frame 10. A cross brace 48 is connected between the support arms 44 to provide for a more rigid construction.

The chain saw blade 28 is pulled downward along its vertical straight-line path through the log 30 by the operator exerting a downward force on the foot bar 42 with his foot as shown by the broken lines in FIG. 2 and in the direction of the arrow 49, which in turn will pull a cable 50 connected between the foot bar 42 and the chain saw blade 28, as will be described in greater detail below.

The portion of the cable 50 connected to the foot bar 42 passes through a pulley 52 which is connected to the underneath side of the vertical support member 26. That portion of the cable is also connected to and wound around the smaller-diameter pulley 54 of a double-diameter pulley arrangement designated by reference numeral 56 which also includes a larger-diameter pulley 58. The pulleys 54 and 58 are keyed onto a shaft 60 so they will rotate together as a unit. The shaft 60 is rotatably mounted by suitable means between one of the front legs 14 and a vertical support member 62 (as best shown in FIG. 3) connected between the top support plate 20 and the bar 46.

One end of the portion of the cable 50 which is connected to the chain saw blade 28 is connected to and wound around the larger-diameter pulley 58. The other end is connected to a coupling mechanism 64 coupled to the front edge of the chain saw blade 28 (best shown in FIG. 5).

The coupling mechanism 64 includes a hook 66 connected to a U-shaped portion 68 which straddles the chain saw blade 28 and is connected to the stationary portion of the blade by a suitable bolt. The coupling mechanism 64 has a suitable space in its central opening to allow the chain portion of the chain saw blade 28 to move freely.

As mentioned above and shown best in FIG. 3, both the smaller diameter pulley 54 and larger diameter pulley 58 are mounted on the shaft 62 to rotate together as a unit, so that when the operator presses on the foot bar 42 the cable 50 will be pulled and unwind from the smaller diameter pulley 54, causing both pulleys 54, 58, to rotate in a clockwise direction. This action causes the portion of the cable 50 connected to the chain saw blade 28 to wind onto the larger diameter pulley 58 and pull the chain saw blade 28 downward along its straight-line path, overcoming the force of the spring 38, to cut the log 30.

When the cutting operation is completed and the pushing force is released from the foot bar 32 the spring 38 will pull downward on the chain saw handle 40 causing the cable 50 to unwind from the larger diameter pulley 58 and to wind back onto the smaller diameter pulley 54 and raise the blade 28 back to the "ready" position.

As can be seen, the operator does not have to hold, support or lift the chain saw and all of the force required to move the chain saw blade to cut a log is applied by the foot of the operator, all of which save exertion and strain on the operator's back. The back is also relieved of much strain because the operator does not have to bend over and instead remains in an upright position while cutting the log. In addition, the operator always has one of his hands free so that he can steady the piece of wood while the other hand remains on the chain saw for controlling its movement and manipulating the throttle.

The inventive apparatus offers significant safety features since the saw blade is confined to a straight-line path and the operator's arms, feet and legs are at all times remote from the path of the blade. In addition, the saw blade is prevented from bucking back toward the operator because the horizontal support 44 for the foot bar 42 is limited in its range of upward movement by the position of the front support brace 16. If the spring 38 should break or become disconnected the maximum forward movement of the blade is restricted by the hinge 22 contacting the top of the support member 24 and top support plate 20, as well as the fact that the operator will always have one hand on the chain saw to operate the throttle.

Thus, there is provided in accordance with the invention a support apparatus which requires significantly less physical exertion by the operator to cut logs with a chain saw, while at the same time providing many important safety features. The embodiment of the invention described above is intended to be merely exemplary and those skilled in the art will be able to make modifications and variations to it without departing from the spirit and scope of the appended claims, all such modifications and variations being contemplated as falling within the scope of the claims.

I claim:

1. A chain saw apparatus for supporting a chain saw of the type having a body with a handle attached thereto and a blade extending outwardly from the body with a toothed cutting chain mounted on the blade, said support apparatus comprising a support frame, means for movably mounting a chain saw on the frame to enable the chain saw blade to move in a substantially straight-line path relative to the frame, the frame including a bed for supporting a length of wood within the straight-line path of the saw blade, means for biasing the saw blade toward one side of the length of wood, foot treadle means including a foot bar pivotally mounted on the frame and a cable connected between the foot bar and the front end of the saw blade, said foot treadle means connected to the saw for overcoming the biasing means and moving the saw blade along the straight-line path to the other side of the length of wood, and a double-diameter pulley means including a first pulley and a second pulley, the diameter of the second pulley larger than that of the first pulley, the first and second pulleys rotatably mounted on the frame and connected to one another to rotate together, the cable portion connected to the foot bar being wound around and connected to the smaller diameter pulley and the cable portion connected to the saw blade being wound around and connected to the larger diameter pulley.

2. The support apparatus of claim 1, wherein the mounting means includes a hinge for mounting the front edge of the chain saw body to the frame.

3. The support apparatus of claim 1, wherein the mounting means is arranged so that the blade will move in a vertical direction and the bed is positioned so that the length of wood is positioned substantially perpendicular to the path of the blade.

4. The support apparatus of claim 1, wherein the biasing means includes a spring connected between the chain saw handle and support frame.

5. The support apparatus of claim 1 wherein the foot treadle means further includes two arms for connecting the foot bar to the frame, the frame further including a support brace extending across the path of the arms for restricting movement of the arms and of the saw blade.

6. The support apparatus of claim 1, wherein the mounting means includes a hinge for mounting the chain saw body to the frame on one side of the length of wood with the chain saw blade extending over the length of wood, and wherein said foot treadle means is pivotally connected to the projecting end of the blade at a point within the endless path defined by the movable chain saw teeth in a manner to pivot the blade on the hinge with substantial leverage in response to actuation of the foot treadle means.

7. The support apparatus of claim 6, wherein the foot treadle means includes a U-shaped coupling member extending freely over the movable chain saw teeth and pivotally connected to the projecting end of the chain saw blade.

8. A chain saw support for supporting a chain saw in working relationship to a workpiece to be cut, the chain saw being of the type having a saw chain mounted on a chain saw blade driven by a motor at one end of the blade, the support comprising:

a support frame having a pivotable hinge secured thereto, said hinge for attachment to the motor portion of a chain saw to permit the blade portion of the saw to sweep through a cut-plane;

said frame having a workpiece bed for supporting a workpiece with the workpiece passing through said cut-plane;

spring biasing means connected to one end thereof to said frame for connection at the other end thereof to the motor portion of the chain saw, said spring biasing means resiliently biasing the blade upwardly in said cut-plane to a ready position in which the blade is located above the workpiece;

a foot treadle movably connected to said frame; and a control cable connected at one end to the remote end of the blade and at the other end to said foot treadle whereby downward movement of said treadle causes said cable to pull the remote end of the blade downwardly toward said workpiece to effect cutting thereof and causes said chain saw to pivot about said hinge against the resilient biasing force provided by said spring biasing means.

9. The chain saw support claimed in claim 8, wherein said spring biasing means comprises:

a helical coil spring in tension having one end connected to said frame and the other end thereof adapted to be connected to the motor portion of the chain saw to resiliently pull the motor portion downwardly and cause the blade to move upwardly towards said ready position.

10. The chain saw support claimed in claim 9 wherein:

said helical coil spring is connected to the underside of said motor portion.

11. The chain saw support claimed in claim 8 wherein:

said foot treadle is pivotally connected to said frame for movement in an upward and downward direction with downward movement of said treadle causing said chain saw blade to be pulled downwardly toward the workpiece.

12. The chain saw support claimed in claim 11 further comprising:

a frame member located above said treadle to limit the upward movement of said treadle and thereby establish the ready position of the blade.

13. The chain saw support claimed in claim 8 further comprising:

a coupling member connected to the remote end of the blade for connecting the blade to said cable, said coupling member including a bifurcated yoke extending on both sides of the blade and a pin connecting said yoke to the blade.

14. The chain saw support claimed in claim 8 wherein the length of the downward stroke of said treadle is less than the length of the downward stroke of said blade and said chain saw support further comprises:

means connected to said cable for multiplying the downward stroke of said treadle to substantially equal the downward stroke of said blade.

15. The chain saw support claimed in claim 8 wherein:

the cable connected to said treadle is entrained about a first pulley and a cable connected to said remote end of the blade is entrained about a second pulley that is secured to said first pulley for rotation therewith, the diameter of said first pulley being less than the diameter of said second pulley.

* * * * *